United States Patent [19]

Dietrich

[11] Patent Number: 4,531,931

[45] Date of Patent: Jul. 30, 1985

[54] APPARATUS FOR OPENING UP FOLDED BOXES

[75] Inventor: Walter Dietrich, Weinstadt, Fed. Rep. of Germany

[73] Assignee: Robert Bosch GmbH, Stuttgart, Fed. Rep. of Germany

[21] Appl. No.: 464,096

[22] Filed: Feb. 4, 1983

[30] Foreign Application Priority Data

Mar. 5, 1983 [DE] Fed. Rep. of Germany ..... 3207902

[51] Int. Cl.[3] ..... B31B 1/80

[52] U.S. Cl. ..... 493/317; 493/309; 53/566

[58] Field of Search ..... 493/309, 313, 315, 316, 493/317; 53/566

[56] References Cited

U.S. PATENT DOCUMENTS 3,293,998 12/1966 Farnow ..... 493/316
3,533,333 10/1970 McIntyre ..... 493/313
3,783,752 1/1974 Langen et al. ..... 493/316
4,061,081 12/1977 Pinto et al. ..... 493/313
4,197,790 4/1980 Dietrich et al. ..... 493/313

*Primary Examiner*—Daniel C. Crane
*Assistant Examiner*—David B. Jones
*Attorney, Agent, or Firm*—Edwin E. Greigg

[57] ABSTRACT

An apparatus for opening folded boxes and delivering the opened boxes to a conveyor device of a cartoning machine including a supply magazine and a delivery device equipped with a suction gripper. In order that the flat-folded boxes will be reliably opened, the apparatus has a holding device with a suction gripper for exerting counter-action during the initial part of the opening operation. The flat-folded boxes are delivered to the holding device by means of a transfer device, suction grippers on the transfer device are moved back and forth on an arc-like path the end portions of which extend substantially perpendicular to the holding plane of the holding device and to the removal side of the magazine. In the initial portion of its return path, the suction gripper of the transfer device still holds the folding box firmly, so that the folding box already opens partially at that time.

7 Claims, 6 Drawing Figures

PRIOR ART

APPARATUS FOR OPENING UP FOLDED BOXES

BACKGROUND OF THE INVENTION

The invention is based on an apparatus for opening up folded boxes. Such an apparatus is known, for example, from German Offenlegungsschrift No. 27 20 902, and has a suction gripper that swings back and forth between a magazine and a conveyor apparatus of a box-making machine. The machine removes one flat-folded box at a time from the magazine and draws the box onto a conveyor apparatus, all in a single motion. A stationary shunt presses against an abutting folded edge of the folded box being carred past it, thus opening up the box and setting it upright. This very simply embodied apparatus functions reliably for common shapes of folded boxes and for an output of up to 250 boxes per minute. However, reliable opening up of the folded boxes is no longer assured when the boxes are relatively flat or tall, or if the material making up the box is not very rigid. An embodiment of the known apparatus is accordingly desired with which folded boxes having a problematical ratio of width to height can be opened up and transferred to a conveyor apparatus and with which it is possible to achieve a high output.

In another apparatus for opening up folded boxes, known for example from U.S. Pat. No. 3,533,333, reliable opening up of the folded boxes is attained in that the folded boxes removed from the magazine are first brought before a suction holder, which by means of a vacuum firmly holds the flat-folded boxes on the side opposite the side to be engaged by the suction gripper for opening the box, until such time as a suction gripper is moved back and forth to engage the other side of that box and has opened it by making a movement away from the suction holder. However, this known apparatus is not capable of a very high output, because a pushing device is required for moving the flat-folded boxes to the suction holder, pushing the lowermost folded box lengthwise out of the magazine using driver devices. The sliding of the folded box on support rails and the friction between it and the other boxes remaining in the magazine mean that a high transfer speed is not possible, and the support rails can also cause scratch marks on folding boxes whose surfaces may be coated with expensive materials.

In order to avoid friction between the folding box being pushed out of a magazine and the box next to it in the stack, a similar apparatus, known from U.S. Pat. No. 3,074,326, has a suction-type removal device, which pulls out the lowermost folding box in the magazine transversely to the plane of the folded box and sets it down in the delivery pusher. The structure of this known apparatus is very expensive, because an additional drive mechanism is required for the suction-type removal device.

OBJECT AND SUMMARY OF THE INVENTION

It is accordingly an object of the invention to produce an apparatus for opening up folded boxes for high—speed box-making machines, which is capable of high output and assures reliable opening up of the folded boxes, even if the boxes have problematical dimensions and are made of material that is not very rigid.

The apparatus for opening up folded boxes according to the invention has the advantage that while attaining the desired object, its structure is very simple and the expense associated with it is quite low, because the only elements requiring a drive mechanism are the transfer device and the delivery device. Since the ends of an arc-like course of the transfer device extend transversely with respect to the plane of the magazine and to that of the holding device, damage-free removal of the folded boxes from the magazine is assured. A compulsory partial opening up of the folded box engaged by the holding device is also attainable by means of the transfer device on its return swing, if the vacuum is not switched off at the point when return begins but rather after part of the arc-like return path has been traversed. The invention furthermore offers the advantage that the apparatus known from German Offenlegungsschrift No. 27 20 902 can be improved for greater output and reliability.

An advantageous embodiment of the opening apparatus disclosed can be attained by means set forth herein.

The invention will be better understood and further objects and advantages thereof will become more apparent from the ensuing detailed description of a preferred embodiment taken in conjunction with the drawings.

BRIEF DESCRIPTION OF THE DRAWINGS

The drawings show one exemplary embodiment of the prior art and one exemplary embodiment according to the invention.

DESCRIPTION OF THE PREFERRED EMBODIMENT

Figure 1:
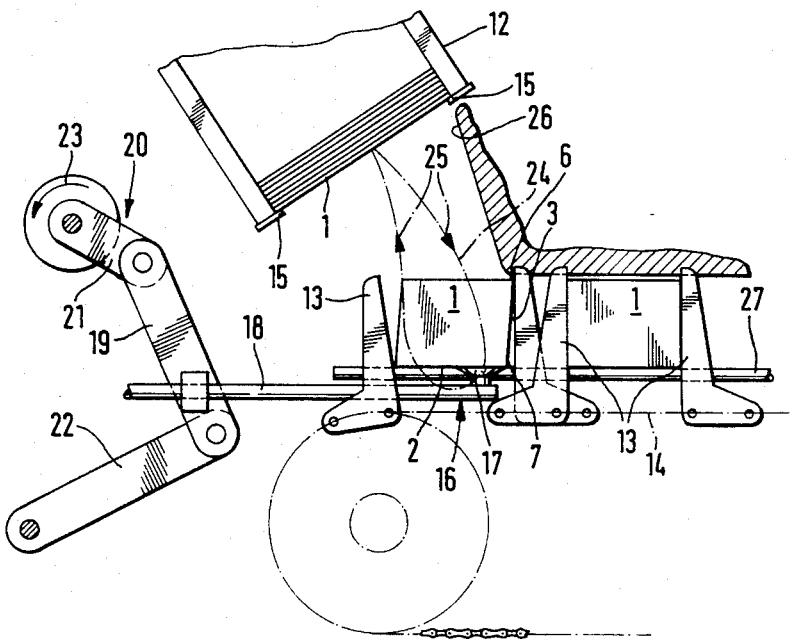
FIG. 1 is a side view of a known apparatus for opening up folded boxes.

The apparatus for opening up folded boxes shown in FIG. 1, which is known from German Offenlegungsschrift No. 27 20 902, has a magazine 12 for receiving a supply of flat-folded boxes 1 above an endless conveyor chain 14 of a cartoning machine. The chain 14 is equipped with driver devices 13. The obliquely positioned magazine 12 has protrusions 15 at its lower, open end, on which the lowermost folding box 1 rests in a position for being removed. A delivery device 16 having at least one suction device 17 is disposed such that it can swing up and down between the bottom of the magazine and the conveyor chain 14. The suction device 17 is seated on the free end of an arm 18, through which air is sucked out and which is secured on connecting bar 19 of a four-bar crank mechanism 20. The crank mechanism 20 has a crank 21 and a control lever 22, both of which are articulately connected with the connecting bar 19. During the course of the continuous movement of the conveyor chain 14 about one set of driver devices 13 at a time, the crank 21 is driven continuously, one revolution at a time, in the direction of the arrow 23, so that the suction device traverses a teardrop-shaped path 24 in the direction indicated by the arrows 25. From the forward side of the magazine 12 (that is, forward in terms of the travel direction of the conveyor chain 14), a stationary shunt 26 extends obliquely downward and then extends parallel to the conveyor and at the distance equal to the height of the folded box 1 from guide rails 27 carrying the folded boxes.

At the top dead center of its movement, the suction device 17 engages the lowermost folding box 1 on its bottom 2, in the area near the folding line 7 toward the front 3 of the folding box 1, by applying a vacuum via a control valve (not shown). During the subsequent arc-like movement of the suction device 17 toward the conveyor chain 14, the folding edge 6 between the front 3 and the top 4 of the folding box 1 strikes the shunt 26 and slides along it. By means of the suction exerted by the suction device 17 on the bottom 2 and the pressure exerted by the shunt 26 on the folding edge 6 between the front 3 and the top 4, the folding box 1 is opened and set upright as it makes its way to the conveyor chain 14, where it finally attains its rectangular form between two spread-apart driver devices 13 and is carried along with them so that it can be filled and closed.

Figure 2:
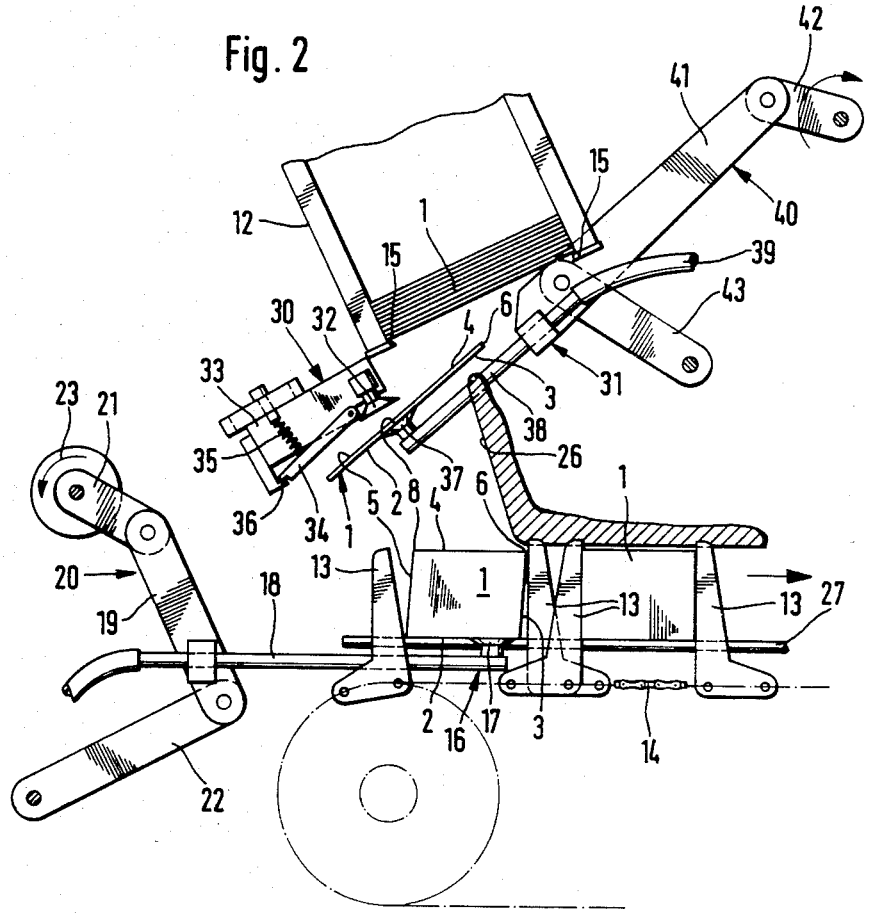
FIG. 2 is a side view of an apparatus according to the invention for opening up folded boxes.

In contrast to the known apparatus for opening up folded boxes as shown in FIG. 1, in which the folded boxes 1 are opened up in a single movement on the way from the magazine 12 to the conveyor chain 14. The apparatus according to the invention and shown in FIG. 2 first carries the boxes from the magazine 1 to a holding device 30 by means of a transfer device 31 and then the boxes are transferred from the holding device to the conveyor chain 14 by the known delivery device 16 as shown in FIG. 1. Since the delivery device 16 of the apparatus according to FIG. 2 has the same design and function as that of FIG. 1, the same reference numerals will be used for the elements of this delivery device and for those of the conveyor chain as before, for the sake of simplicity.

The holding device 30 is disposed in the vicinity of top dead center of the suction device 17 of the delivery device 16. It has a stationary suction gripper, directed obliquely downward, in the form of at least one suction device 32, which communicates intermittently via a control valve (not shown) with a vacuum source. The suction device 32 is secured to a carrier 33, on which a pressure device 34 is also supported so as to be rotatable about an axis located next to the suction device 32, in such a manner that the pressure device 34 is pivotable by a compression spring 35 out of the plane of the suction device 32 and toward the delivery device 16 about an angle defined by a stop 36. The magazine 12 receiving the supply of folding boxes is disposed in an oblique position next to the holding device 30, and its lower side which yields the folding boxes is located in a plane that is substantially parallel to the holding plane, that is, the plane in which the holding device 30 performs its function.

For transferring folded boxes 1 from the magazine 12 to the holding device 30, the transfer device 31 has a suction gripper in the form of at least one suction device 37, which is at the free end of a hollow rod 38 and is directed toward the underside of the magazine 12 and of the holding device 30. By means of the hollow rod 38, a hose 39 and a control valve (not shown), the suction device 37 can be made to communicate with a source of vacuum. The rod 38 is firmly connected to the connecting bar 41 of a four-bar mechanism 40 which, in addition to the connecting bar 41, has a rocker arm 42 and a control bar 43. The rocker arm 42 is pivoted intermittently about an angle of about 200°. The suction device 37 thereupon moves back and forth along an arc-like curved path 44 (FIG. 3), with dead center points at the underside of the magazine 12 and in the holding plane of the suction device 32 of the holding device 30; the end zones of the curved path 44 extend substantially perpendicular to the underside of the magazine 12 and to the holding plane of the holding device 30 (FIG. 3).

Figure 3:
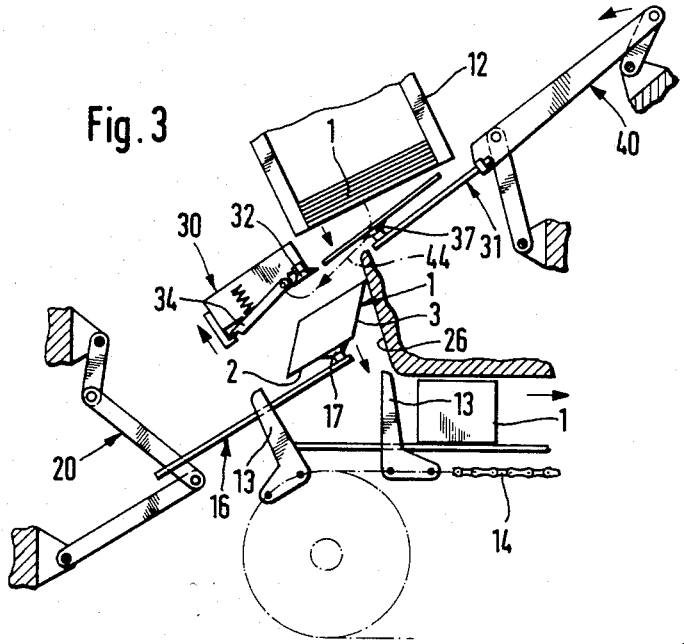
FIGS. 3–6 illustrate the apparatus for opening up folded boxes according to FIG. 2, in simplified form and in various operating positions.
Figure 4:
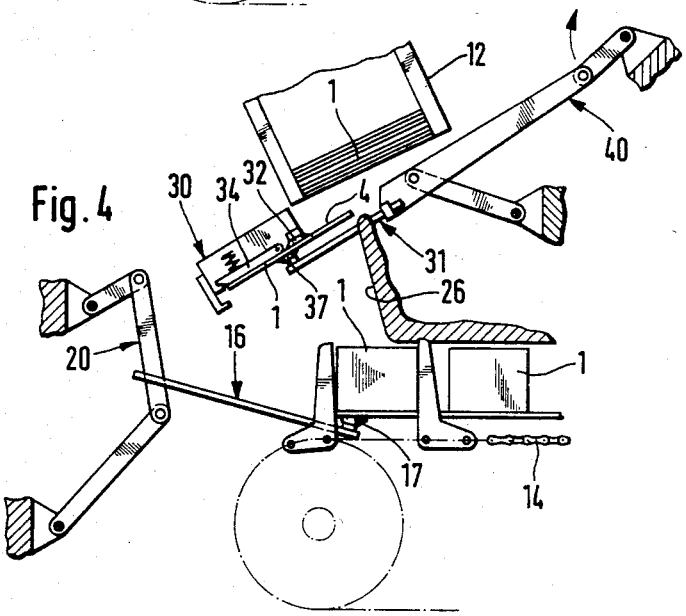
Figure 5:
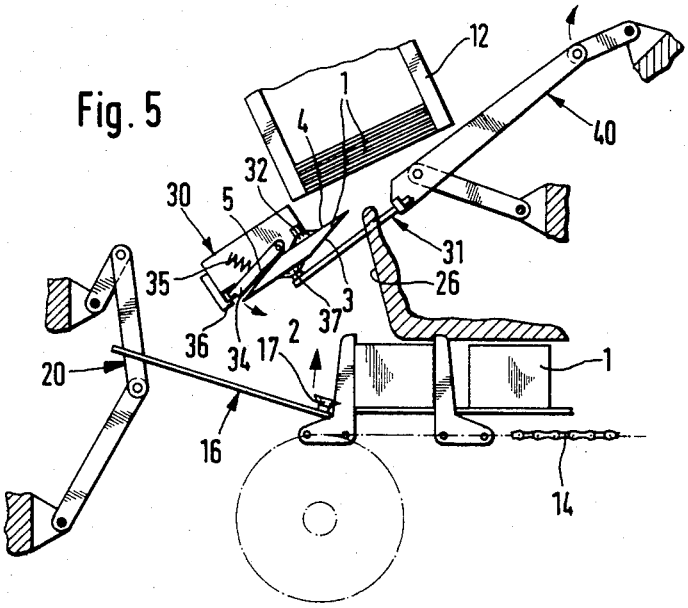
Figure 6:
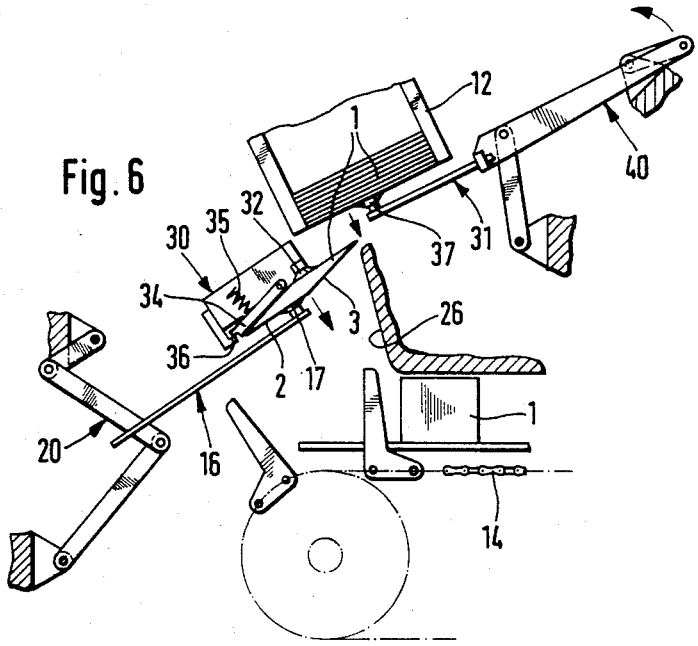

The apparatus described above and shown in FIG. 2 operates as follows, as illustrated in simplified form in FIGS. 3–6;

In its dead-center position at the magazine 12, the suction device 37 of the transfer device 31, engages the lowermost folded box 1 in the magazine 12 by applying a vacuum and in the first portion of its path, draws the folded box out of the magazine 12 and toward the transfer device 30; the folded box 1 lies transversely to the initial direction of movement (FIGS. 6 and 3). The suction device 37 engages the bottom 2 of the folding box 1 near the folding line 7 toward the front 3. The transfer device 31 rapidly brings the thus-engaged folded box 1 along the arc-like curved path 44 into the holding plane of the holding device 30, where the suction device 32, which in the meantime has been connected with the source of vacuum, engages the folded box 1 on its top 4, near the folding line 8 toward the back 5 (FIG. 4). From this dead-center point of the vicinity of the holding device 30, the suction device 37 reverses direction and returns back to the magazine 12 on the curved path 44. As the suction device travels through the initial portion of this return movement, the suction device 37 of the transfer device 31 still remains connected with the vacuum source, so that the folding box 1 which is engaged on its top 4 by the suction device 32 of the holding device 30 is partly opened into the shape of a parallelogram having an opening width of approximately 10° to 15°, FIG. 5. This partial opening is reinforced by the pressure device 34, which, resting on the back 5 of the folding box 1, presses the box toward the transfer device 31 (FIG. 5).

While the suction device 37 of the transfer device 31 is swinging back to the magazine 12, the crank mechanism 20 of delivery device 16 moves the suction device 17 of the delivery device 16 toward the holding device 30. At the top dead center of suction device 17, which is located somewhat below the holding plane of the suction device 32 of the holding device 30, the suction device 17 engages the partially opened folded box 1 on its bottom 2 (FIG. 6). The box is still being held temporarily on the top 4 by the suction device 32 of the holding device 30. The suction device 7 draws the box to a position between one pair of driver devices 13 of the continuously moving conveyor chain 14, during movement by suction device 17, the folded box 1 is released by suction device 32 and the box is completely pressed open on the folding edge 6 by the shunt 26 and set upright in the driver device 13 (FIGS. 3 and 4).

By means of the suction device 32 of holding device 30, which is supplied with one folded box 1 at a time by the transfer device 31 and which in counteraction with the suction gripper 17 of delivery device 16 and suction gripper 37 of the transfer device 31 the suction device 32 engages the top 4 of the folding box 1 and holds it partially open, reliable opening of the folded boxes is assured, even when these boxes are made of cardboard which is not very rigid. Furthermore, the partial opening of the transferred folded boxes 1 by the returning transfer device 31 increases the output of the apparatus according to the invention as compared with that of the prior art.

It should additionally be noted that the position of the magazine may also be relatively flatter or steeper than what is shown in the drawings, and that shifting it to adapt to the shape of the folding boxes is easily accomplished. What is important, if the magazine is disposed differently, is that the end portions of the curved path of the suction gripper of the transfer device should extend substantially perpendicular to the end of the magazine and to the holding plane of the holding device.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for opening flat-folded boxes and delivering the opened boxes to a moving conveyor which comprises:

a stationary magazine which receives said folded boxes, a holding station disposed adjacent said magazine, said holding station including a first stationary suction gripper for gripping an upper side of each folded box after removal from said stationary magazine, a transfer device positioned relative to said magazine and said holding station, said transfer device including a second suction gripper for removing one flat-folded box at a time from said magazine and for transferring said flat-folded box from said magazine to said holding device, said transfer device further including a linkage mechanism upon which said second suction gripper is supported and which moves said second suction gripper back and forth on an arc-like path between a dead-center point under said magazine to said holding device, said first suction gripper adapted to grip an upper side of said flat box received from said second suction gripper and to operate with said second suction gripper to partially open said flat folded box, a moving conveyor for receiving opened boxes, a delivery device for completely opening said folded box and delivering said completely opened box to said moving conveyor, said delivery device including a third suction gripper, means for moving said third suction gripper back and forth between said holding device and said moving conveyor, said third suction gripper adapted to grip a bottom side of said box transferred to said holding device and adapted to move the box to said moving conveyor, a stationary shunt means positioned between said magazine and said moving conveyor adapted to press said box to an open position when said third suction gripper delivers said partially open box from said holding device to said moving conveyor.

2. An apparatus as defined by claim 1, characterized in that said linkage mechanism is a four-bar linkage, including an elongated connecting bar which supports said second suction gripper.

3. An apparatus as defined by claim 1, characterized in that said suction gripper of the holding device engages the top of the folded box, and a resilient pressure member supported on said holding device which presses against a side wall adjoining the top of the folded box.

4. An apparatus as defined by claim 2, characterized in that said suction gripper of the holding device engages the top of the folded box, and a resilient pressure member supported on said holding device which presses against a side wall adjoining the top of the folded box.

5. An apparatus as defined by claim 1, which includes means for producing a vacuum in the suction gripper of the transfer device in the initial portion of the movement of the suction gripper from the holding device back to the magazine whereby the transfer device partially opens the folded box being held by the holding device.

6. An apparatus as defined by claim 2, which includes means for producing a vacuum in the suction gripper of the transfer device in the initial portion of the movement of the suction gripper from the holding device back to the magazine whereby the transfer device partially opens the folded box being held by the holding device.

7. An apparatus as defined by claim 3, which includes means for producing a vacuum in the suction gripper of the transfer device in the initial portion of the movement of the suction gripper from the holding device back to the magazine whereby the transfer device partially opens the folded box being held by the holding device.

* * * * *